United States Patent [19]

Sacchetti

[11] 4,072,921

[45] Feb. 7, 1978

[54] LOW INDUCTANCE PRECISION RESISTOR DEPOSITED ON AN ADHESIVE BACKING AND WOUND ON A BOBBIN

[75] Inventor: Peter John Sacchetti, Manchester, N.H.

[73] Assignee: AMF Incorporated, White Plains, N.Y.

[21] Appl. No.: 680,717

[22] Filed: Apr. 27, 1976

[51] Int. Cl.[2] ..... H01C 3/02

[52] U.S. Cl. ..... 338/61; 29/618; 29/620; 156/47; 156/177; 156/436; 242/7.03; 242/7.09; 338/207; 338/210; 338/212; 338/279; 338/299; 338/302

[58] Field of Search ..... 338/61, 62, 207, 210, 338/212, 279, 280, 282, 296, 284, 267, 297, 287, 299, 292-294, 333, 334, 302; 219/549, 552, 553; 29/618, 620, 610; 242/7.03, 7.09; 156/47, 177, 436

[56] References Cited

U.S. PATENT DOCUMENTS

| | | | |
|---|---|---|---|
| 1,976,514 | 10/1934 | Puch, Jr. | 338/62 X |
| 2,719,907 | 10/1955 | Combs | 219/549 X |
| 2,860,220 | 11/1958 | Keeler | 338/211 X |
| 3,128,956 | 4/1964 | Schumann | 242/7.09 |
| 3,166,104 | 1/1965 | Foley, Jr. et al. | 242/7.09 X |
| 3,541,491 | 11/1970 | Worster | 338/211 |

*Primary Examiner*—C. L. Albritton

*Attorney, Agent, or Firm*—George W. Price; John H. Gallagher

[57] ABSTRACT

A precision resistor wherein the resistor wire is deposited in a sinuous pattern on the adhesive surface of a thin, flexible tape of electrical insulating material. In winding the tape onto a multibobbin coil form the intermediate flanges of the coil form have a flat portion of reduced radius.A coil of tape is wound on one bobbin with the adhesive side against the bobbin and is passed over the flat portion of an intermediate flange. At the crossover the tape is pressed to conform to the shape of the flange and then passed around the axial body of the adjacent bobbin to commence the winding of the next coil of tape on the adjacent bobbin.

16 Claims, 3 Drawing Figures

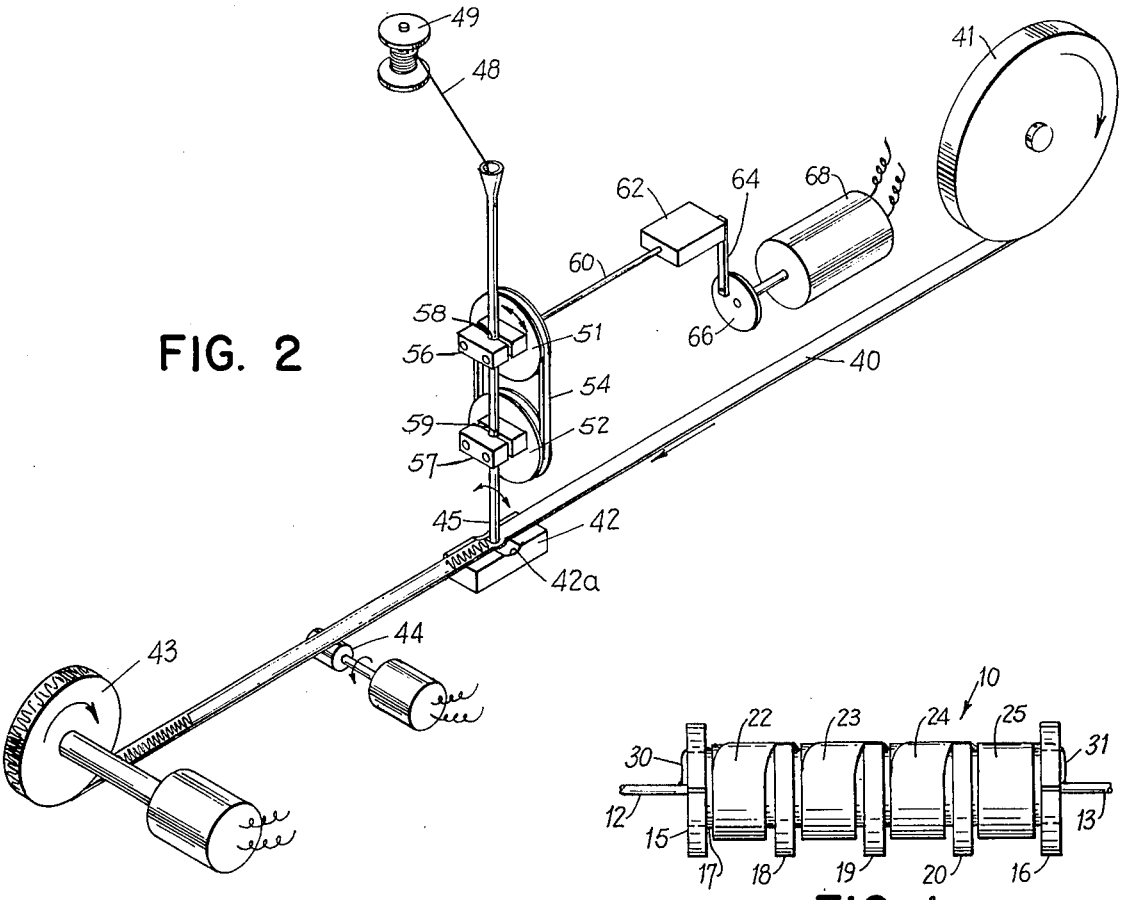
FIG. 2
FIG. 1
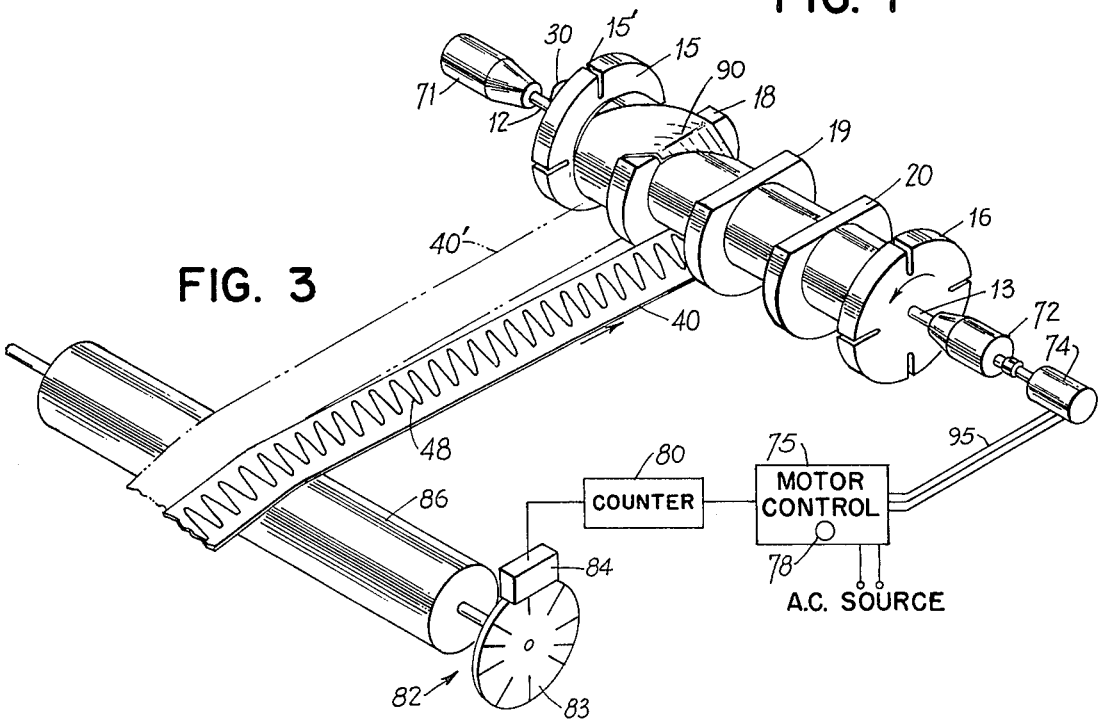
FIG. 3

LOW INDUCTANCE PRECISION RESISTOR DEPOSITED ON AN ADHESIVE BACKING AND WOUND ON A BOBBIN

BACKGROUND OF THE INVENTION

A common form of a precision resistor is a length of relatively thin resistance wire wound as a multilayer coil on a coil form or bobbin. As is well understood, one disadvantage associated with this form of wire wound resistor is that the multilayer coil has appreciable inductive reactance which is undesirable for many uses of the resistor. Many different coil winding techniques and many different forms of resistor elements have been devised in attempts to minimize the inductive reactance associated with this type of resistor.

It is known in the art to deposit a resistor wire on the adhesive backing of a thin sheet of insulator material and then roll the tape into a tight spiral, or fold it back and forth accordion style before encasing it in a housing. Conventional coil forms that are commonly employed in wire wound resistors are not used. U.S. Pat. Nos. 2,860,220 — Keeler, and U.S. Pat. No. 3,541,491 — Worster, disclose resistors manufactured as described above. Furthermore, precision resistors of large resistance values require a very long length of resistor wire. In the manufacture of wire wound resistors, for example, multibobbin coil forms are used. In such multibobbin resistors, the wire is passed through a slot in a common flange between adjacent coils. In the winding of a multibobbin wire resistor, the crossover from a full bobbin to the cylindrical body of an empty bobbin presents no particular problem. However, when working with a relatively wide tape having the thin resistor wire deposited thereon, the crossover presents a problem since the tape must cross over from the outside of the full coil to the inside of the empty spool, and then be wound from the inside to the outside of the spool.

Workers trained to wind conventional wire wound resistors are familiar with and adept in working with coil forms, and if they may continue to apply their skills in winding tape on a bobbin or coil form, a minimum of retraining is required. Additionally, winding directly onto a coil form is considerably simpler than some of the procedures suggested in the above-mentioned patents for making a multicoil resistor.

A further advantage of using a coil form with a tape having resistance wire thereon is that the mechanical support and rigidity provided by the coil form is retained. Also, the relatively stiff connector lead of the coil form are retained.

SUMMARY OF THE INVENTION

The invention concerns a low inductance precision resistor wherein the resistor wire is laid or deposited on an adhesive surface of a thin, flexible tape of insulator material. The resistor wire is deposited in a continuous sinuous or serpentine pattern comprised of back and forth passes that are transverse to the length of the continuous tape. In this manner, a high value of resistance per unit length of the tape is obtained. Additionally, because of the accurate manner in which the wire is laid onto the adhesive surface of the tape, the resistance value per unit length of tape is constant and precise throughout the entire length of the continuous tape so that an accurate resistance value may be obtained merely by measuring a given length of tape.

The tape with the resistor wire inherently has very little inductive reactance associated with it, and because fewer turn of the tape are wound on a bobbin, the inductive reactance of the coil of tape with resistor wire thereon is minimized.

Additionally, novel techniques and procedures are employed in winding prepared tape onto a multibobbin coil form.

BRIEF DESCRIPTION OF THE DRAWINGS

FIG. 1 is an illustration of a low inductance precision resistor constructed in accordance with the teachings of this invention;

FIG. 2 is a simplified illustration of the apparatus and method for placing resistor wire in a sinuous pattern onto an adhesive surface of a thin, flexible tape of insulator material; and FIG. 3 is a simplified illustration of the apparatus and method of winding prepared tape onto a multibobbin coil form.

DESCRIPTION OF PREFERRED EMBODIMENT

A low inductance precision resistor constructed in accordance with the teachings of this invention is illustrated in FIG. 1 and is comprised of a multibobbin coil form 10 having relatively stiff connector leads 12 and 13 extending axially outwardly from the respective disc shaped end flanges 15 and 16. Intermediate flanges 18, 19 and 20 are evenly spaced along an axial cylinder 17 between end flanges 15 and 16 to form four axially disposed winding bobbins or spools. As will be described below, each of the intermediate flanges 18, 19 and 20 has a chordal flat portion at a location on its periphery. Coil form 10 is molded as a unitary body from a suitable electrical insulator plastic material.

The resistor wire is placed on the adhesive surface of a thin tape of flexible insulating material, as will be described below, and a continuous length of the tape is wound onto successive coils or rolls 22, 23, 24 and 25 on the axially adjacent bobbins of coil form 10. One end 30 of the resistor wire is spot welded or soldered to the left connector lead 12 and the other end 31 of the wire is similarly secured to the right connector lead 13.

The manner in which the resistor wire is deposited onto the tape is illustrated in FIG. 2. A continuous length of thin, flexible, electrical insulating tape 40 having an adhesive material on only one surface is provided on a payout reel 41 which is suitably supported to allow the tape to be unwound therefrom with a relatively small force. Tape 41 may be any of a variety of commercially available tapes. I presently prefer to use a tape sold under the trademark Mylar. The tape is passed over a support or backing block 42 onto a motor driven take-up reel 43. The motor driven capstan 44 advances tape 40 at a predetermined constant speed.

Disposed vertically over the tape 40 and backing block 42 is an oscillating hollow tube 45. The resistor wire 48 from a supply spool 49 enters the top end of tube 45 and passes therethrough to the bottom end from where it is laid onto the adhesive surface of tape 40 in a sinuous pattern. Vertical tube 45 oscillates back and forth along a short arcuate path in a vertical plane so that at one extreme position of its motion it contacts the adhesive surface of tape 40 and deposits wire 48 on one edge region of the tape and at the opposite extreme portion of its motion it contacts the adhesive surface of the tape and deposits wire 48 at the opposite edge region. Intermediate the two extreme end positions of the tube it rises vertically and is out of contact with the adhesive surface of tape 48. Because of the advancing motion of tape 40 in a direction normal to the plane in which tube 45 oscillates, the wire 48 takes on a sinuous or serpentine pattern as it is deposited onto the adhesive surface of tape 40.

The desired resistance value for a unit length of prepared tape 40 on the take-up reel 43 is a function of the resistance per unit length of wire 48, the speed of linear travel of tape 40, and the speed and amplitude of the oscillatory motion of tube 45 as it deposits resistor wire on the tape. Because the speed of linear travel of tape 40 and the amplitude and period of oscillation of vertical tube 45 both may be accurately controlled, the sinuous pattern of resistor wire 48 is very uniform and the resistance value per unit length of the tape is accurate and repeatable throughout the length of a prepared tape.

The oscillatory motion may be imparted to hollow tube 45 by a variety of different means and mechanisms. The means illustrated in FIG. 2 are comprised of discs 51 and 52 which are rotatably mounted in vertically aligned, spaced apart relationship. An endless belt 54 passes over both discs to couple them together for rotary motion. Split mounting blocks 56 and 57 each has a journal which is received in a bearing (not illustrated) in the face of a respective disc 51 and 52. Split mounting blocks 56 and 57 have respective apertures 58 and 59 which extend vertically therethrough for holding hollow tube 45 in a vertical position. Split blocks 56 and 57 both are journaled into their respective discs 51 and 52 at the same eccentric angular position so that as the two discs rotate in synchronism by means of belt 54, tube 45 will remain vertical.

An axial drive shaft extends from driven disc 51 and has a rocker arm 62 secured at its outer end. A vertically reciprocating crank arm 64 is pivotally connected at one end to rocker arm 62 and at its other end is pivotally connected at an eccentric location to wheel 66. Wheel 66 is rotated at a desired r.p.m. by means of motor 68 and any suitable speed reduction mechanism, if required.

In the operation of the mechanism just described, consider that the split mounting blocks 56 and 57 have their respective journals and brushings at the uppermost and center position of their symmetrical oscillatory paths, i.e., at 0°, that rocker arm 62 is horizontal, and that the pivot connection of crank arm 64 and wheel 66 is in a horizontal plane that passes through the axis of rotation of wheel 66. As motor 68 turns wheel 66, eccentrically pivoted crank arm 64 will reciprocate up and down and will impart a rocking motion to rocker arm 62. Axial shaft 60 in driven disc 51 thus is oscillated through an angular segment which is chosen so that the extreme ends of that angular segment are at the respective side regions of flexible tape 40. Because of the described construction and arrangement, hollow tube 45 will be at its highest position above tape 40 when it is substantially centered over the tape. As the journaled connections of the mounting blocks 56 and 57 pass to each side of their 0° positions, the bottom end of hollow tube 45 will move progressively closer to the adhesive surface of tape 40 and progressively closer to a side edge. At the extreme ends of the symmetrical arcuate motion of tube 45 its bottom end contacts the adhesive surface of tape 40 with an empirically determined light force to attach the wire at a side region of the tape. Because tape 40 is advancing past the end of hollow tube 45 at a uniform speed, the wire will take on a sinuous pattern as it is laid onto tape 40. The adhesive backing on tape 40 secures the deposited wire 48 to the tape and the adhesive force therebetween is sufficient to pull wire 48 off freely rotatable supply spool 49 and through hollow tube 45. With the arrangement described, wire 48 is deposited onto tape 48 in an unstressed condition.

As illustrated in FIG. 2, tape 42 is supported and guided by a backing block 42 in the region immediately below the oscillating tube 45. It has been found that a transverse recess or void space 42a at the location where tube 45 contacts tape 40 permits some slight yielding of the tape and improves the operation.

The resistance per unit length of a prepared tape may be changed by changing the wire and/or by changing the speed of linear travel of tape 40.

Reels of flexible insulator tape having the resistor wire wound thereon may be prepared in large quantities for subsequent winding onto coil forms, as now will be described.

Referring to FIG. 3, the connector leads 12 and 13 of coil form 10 are secured in the chucks 71 and 72 of a motor driven rotary device such as a pin chuck. Motor 74 is adapted to rotate coil form 10 in the direction indicated in FIG. 3. The starting and stopping of motor 74 is controlled by a motor control unit 75 which has a manual start button 78 and an automatic stop control. A stop command signal is coupled to motor control unit 75 from a presettable, or programmable, counter 80. The input to counter 80 is a series of pulses which are produced by a shaft encoder device 82 which is comprised of a code wheel 83 and a pulse producing unit 84. Shaft encoders are readily available on the commercial market and take a variety of forms. As one example, code wheel 83 may be a translucent disc having a great number of radially extending opaque lines, bars, or segments, uniformly spaced about a face thereof. Pulse producing unit 84 may be comprised of a light coupler which has a light source on one side of code wheel 83 that directs a beam of light through code wheel 83 to a light detector on the other side. As code wheel 83 rotates, the opaque segments thereon will repeatedly interrupt the light beam so that the light detector receives a succession of light pulses. The number of light pulses received by the light detector is proportional to the angular rotation of code wheel 83. The light detector produces a corresponding series of electrical pulses in response to the light pulses. A suitable shaft encoder is manufctured by Durant Digital Instruments, Watertown, Wisconsin, as part number 393-00-100.

Code wheel 83 of shaft encoder 82 is directly connected to a freely rotatable roller 86. Desirably, roller 86 is several times longer than coil form 10. For example, if coil form 10 is 1.25 inches long, roller 86 will be 3.0 inches long.

The precision resistor is wound on coil form 10 in the following manner. A full reel of tape with the resistor wire deposited thereon in the sinuous pattern is rotatably supported with its axis of rotation parallel to the axis of rotation of coil form 10 in the pin chuck, see FIG. 3. With the coil form and roller 86 of the dimensions given above, the full roll of prepared tape may be laterally spaced approximately 2 feet from coil form 10. The end of tape 40 is unwound from the reel and is passed over roller 86 with the adhesive side and resistor wire 48 facing upwardly. The end of the tape is attached by means of its adhesive surface to the cylindrical body of the left end bobbin of coil form 10 and the end 30 of the resistor wire is passed through the radial slot 15' in end flange 15.

Settable, or programmable, counter 80 is set to produce an output pulse when it has received from shaft encoder 82 a number of pulses which correspond to the length of tape desired to be wound on the first bobbin of coil form 10. When using a four bobbin coil form, that predetermined length is approximately one-fourth the length of tape required to provide the desired final resistance value of the resistor.

Start or reset button 78 on motor control unit 75 is depressed to energize motor 74. Coil form 10 will rotate in the direction indicated. The prepared tape 40, illustrated in phantom in FIG. 3, begins winding onto the empty first bobbin. Because the tape is in contact with and passes over the freely rotatable roller 86, the roller rotates as the tape advances. Shaft encoder 82 produces a succession of pulses which are accumulated in counter 80. As the layers of tape build up on the first bobbin of coil form 10, the count in counter 80 builds up until the predetermined count is reached. Counter 80 then produces an output command pulse which is coupled to motor control unit 75 to actuate suitable circuitry and/or apparatus which interrupts power to motor 74, thereby immediately stopping the rotation of coil form 10. Known solid state and/or electromechanical apparatus are available for performing the function of motor control unit 75 and will not be further described. Counter 80 automatically is reset to zero count after it produces its output pulse.

Braking means may be provided to stop motor 74 immediately upon occurrence of a command pulse from counter 80. The braking means may be dynamic or electromechanical An appropriate signal is coupled over lead 95 to motor 74 to initiate the braking action.

The machine operator then manually rotates coil form 10 and passes tape 40 over the flat portion of intermediate flange 18 to form a cross-over portion 90. The operator presses the adhesive surface of insulator tape 40 against the right face of flange 18 and around the cylindrical body portion of the second bobbin so that the tape will not obstruct subsequent wraps of the tape onto the second bobbin of the coil form. The operator continues to slowly rotate the coil form and guides the tape around the bottom of the cylindrical portion of the second bobbin of the coil form until the condition illustrated in full lines in FIG. 3 is reached. In one embodiment of coil form 10, each of the flat portions of reduced diameter on the intermediate flanges 18, 19 and 20 was along a chord of the disc, and the chord was approximately tangential to the cylindrical body 17 of each bobbin. Because of this flat portion the tape must pass from one full bobbin to the adjacent empty bobbin without interfering with normal winding of the tape onto the empty bobbin. The operator must be careful to press the adhesive side of the tape into good conforming contact with the surfaces of the bobbin to prevent any bulges or protrusions from being formed which could interfere with the smooth winding of the tape onto the empty bobbin. Of course, the tape must be sufficiently flexible and yielding to permit it to substantially conform to the bobbin shape were desired. Also, the portions of reduced radius on the intermediate flanges 18, 19 and 20 could be arcuate rather than chordal.

Start button 78 on motor control unit 75 again is depressed to start motor 74 and to again rotate coil form 10. Advancing tape 40 rotates roller 86 to cause shaft encoder 82 to again produce a series of pulses which are counted in counter 80. Layers of wound tape are built up on the second bobbin between flanges 18 and 19 until the second predetermined length of tape is wound, this being indicated by counter 80 producing a second output command pulse. Motor control unit 75 responds to the command pulse to disconnect power from motor 74 and apply a brake thereto, thus stopping the rotation of coil form 10. The operator again manually rotates the coil form and makes a cross-over portion, similar to cross-over 90, over the flat portion of intermediate flange 19 and brings the tape around the bottom of the cylindrical portion of the third bobbin, just as is illustrated in FIG. 3 for the second bobbin.

The described procedure is repeated until respective predetermined lengths of tape 40 have been wound on all the bobbins. On the last bobbin, the operator winds an additional short length of tape onto the bobbin and then cuts the tape. Resistance tests are then made. Initially, the resistance value will be greater than the desired precise value. The operator manually cuts short lengths of tape from the last bobbin until the resistance value is within specifications. The free end 31, FIG. 1, of the resistor wire then is passed through a radial slot in end flange 20 and both the free ends 30 and 31 are welded to terminals 12 and 13.

It is seen in FIG. 3 that the resistor wire is on the inside surface of the wound tape and thus protected from damage.

If desired, the wound coil from 10 now may be placed in a housing and sealed or potted in plastic insulator material to form a finished product. Because this procedure forms no part of the present invention it will not be further described.

From the above disclosure, alterations and modifications may be obvious to those skilled in the art. For example, a single bobbin may be wound as described. ALso, referring to FIG. 1, tape 40 may have adhesive material on both sides and resistor wire could be applied to both sides at the same time by adding another oscillating tube 45 to apply resistor wire to the opposite side of the tape. In this case, insulation may be required between turns of the wound tape. Furthermore, the resistor wire on tape 40 could be applied as a printed conductor by any of the printed circuit techniques. In this latter case, it would not be necessary that one side of the tape be continuously covered with adhesive material.

In its broader aspects, this invention is not limited to the specific embodiment illustrated and described. Various changes and modifications may be made without departing from the inventive principles herein disclosed.

What is claimed is:

1. The method of making a low inductance precision resistor comprising the steps advancing along a path a continuous length of thin, flexible tape of electrical insulating material, depositing a continuous length of resistor wire in a sinuous pattern on a surface of side said advancing tape, winding said tape with the resistor wire thereon onto the axial extending portion of a bobbin that includes radially extending flanges at each end, the side of the tape having the wire thereon being placed in contact with the bobbin when commencing the winding.

2. The method of making a low inductance precision resistor comprising the steps advancing along a path a continuous length of thin, flexible tape of electrical insulating material having at least one adhesive side, depositing a continuous length of resistor wire in a sinuous pattern on the adhesive side of said advancing tape, winding said tape with the resistor wire thereon onto the axial extending portion of a bobbin that includes radially extending flanges at each end, the adhesive side of the tape being placed in contact with the bobbin when commencing the winding.

3. The method of making a low inductance precision resistor comprising the steps advancing along a path a continuous thin, flexible tape of electrical insulating material, depositing a continuous resistor wire in a transverse back and forth pattern on one surface of said advancing tape, attaching said surface at a free end of said tape with the resistor wire thereon to an axial body of an end bobbin of multibobbin coil form that has end flanges and one or more intermediate flanges that are common to adjacent bobbins, wherein each intermediate flange has a portion that is of reduced radial extent said portion being at least as wide as said tape, rotating said coil form about its longitudinal axis, winding a predetermined length of the tape with resistor wire thereon onto an end bobbin of the coil form, passing said continuous tape across that portion of the adjacent intermediate flange that is of reduced radial extent and about the adjacent bobbin, and winding a predetermined length of the continuous tape onto the adjacent bobbin.

4. The method claimed in claim 3 and including the step, substantially conforming said tape to the surfaces of said adjacent intermediate flange and the axial body of said adjacent bobbin as the tape is passed over said intermediate flange and positioned for a first wrap about the adjacent bobbin.

5. The method of making a low indictance precision resistor comprising the steps advancing along a path a continuous, thin, flexible tape of electrical insulating material having at least one adhesive side, depositing a continuous resistor wire in a sinuous pattern on the adhesive side of said advancing tape, attaching the adhesive side of a free end of said tape with the resistor wire thereon to an end bobbin of a multibobbin coil form having end flanges and one or more intermediate flanges that are common to adjacent bobbins, rotating said coil form about its longitudinal axis, winding a predetermined length of the tape with resistor wire thereon onto an end bobbin of the coil form, passing said continuous tape across the adjacent intermediate flange onto the adjacent bobbin, and winding a predetermined length of the continuous tape onto the adjacent bobbin.

6. The method of making a low inductance precision resistor comprising the steps advancing along a path a continuous, thin, flexible tape of electrical insulating material having at least one adhesive side, depositing a continuous resistor wire in a transverse back and forth pattern along the adhesive side of said advancing tape, winding onto a reel said continuous length of prepared tape having the wire thereon, attaching the adhesive side of a free end of said reel of prepared tape to the cylindrical body of an end bobbin of a multibobbin coil form having radially extending end flanges and one or more intermediate flanges that are common to adjacent bobbins, said intermediate flanges each having at least a portion of reduced radius, rotating the coil form about its longitudinal axis, winding a first predetermined length of tape from the reel onto an end bobbin of the rotating coil form, stopping the rotation of the coil form, passing the tape transversely over the reduced radius portion of the first intermediate flange and starting it around the cylindrical body portion of the adjacent bobbin, at least partially conforming said tape to the shape of the first intermediate flange and said adjacent bobbin as it is passed over said first intermediate flange onto the adjacent bobbin, rotating the coil form and winding a second predetermined length of the continuous prepared tape from the reel onto said adjacent bobbin.

7. A low inductance precision resistor, comprising a coil form comprised of at least one bobbin having an axially extending body portion and radially extending flanges on each end, terminal means on said bobbin, a continuous tape of thin, flexible electrical insulating material, a resistive conductor having a given resistance value per unit length deposited along the length of said tape in a continuous transverse back and forth pattern, said tape with the conductor thereon being wound about the body portion of the bobbin, means connecting the ends of said conductor to said terminal means.

8. The combination claimed in claim 7 wherein said conductor is a resistor wire.

9. The combination claimed in claim 8 wherein said resistor wire is deposited in a uniform sinuous pattern.

10. The combination claimed in claim 9 wherein said tape has adhesive material on one surface and said wire is deposited on the adhesive surface.

11. The combinagtion claimed in claim 7 and including, a second bobbin on said coil form, the two bobbins sharing a common radially extending flange, said flange having a portion at least as wide as the tape which is closer to the body portions of the bobbins that the remainder of the common flange, said continuous tape with the conductor thereon passing over said portion of the common flange which is closer to said body portions and being wound onto said second bobbin.

12. A low inductance precision resistor, comprising a coil form having a plurality of adjacent bobbins comprised of first and second radially extending end flanges and one or more intermediate flanges that are common to adjacent bobbins, said bobbins each including an axial body portion between spaced flanges, at least two terminal means associated with said coil form, a continuous tape of thin, flexible, electrical insulating material, a resistive conductor having a given resistance value per unit length deposited in a continuous sinuous pattern along the length of the tape, said continuous tape with the conductor thereon being wound in multiple turns successively around each of said bobbins, said tape with the conductor thereon passing from one wound bobbin over an intermediate flange and being positioned into substantial conformance with the surfaces of said flange and then the axial body of the adjacent bobbin as it crosses over between bobbins and takes on a first encircling turn about the axial body of said adjacent bobbin, and means for electrically connecting opposite ends of the conductor to respective ones of said terminal means.

13. The combination claimed in claim 12 wherein, each of said intermediate flanges has a portion thereof of reduced radius, said tape passing over the reduced radius portion.

14. The combination claimed in claim 13 wherein at least a part of the reduced radius portion of each intermediate flange is substantially the radius of the axial body portion of the respective bobbin.

15. The combination claimed in claim 12 wherein said tape has an adhesive material on at least one surface thereof.

16. The combination claimed in claim 15 wherein said conductor is a resistor wire deposited onto said adhesive surface.

* * * * *